United States Patent [19]

Dorpmund

[11] 4,441,678

[45] Apr. 10, 1984

[54] MOUNTING FOR A TANK RECEPTACLE IN A SUPPORTING FRAMEWORK

[75] Inventor: Willi Dorpmund, Elze, Fed. Rep. of Germany

[73] Assignee: Graaff Kommanditgesellschaft, Elze, Fed. Rep. of Germany

[21] Appl. No.: 249,328

[22] Filed: Mar. 31, 1981

[30] Foreign Application Priority Data

Apr. 2, 1980 [DE] Fed. Rep. of Germany ..... 3012938

[51] Int. Cl.[3] ..... A47G 25/00

[52] U.S. Cl. ..... 248/146; 220/1.5

[58] Field of Search ..... 248/146, 555, 176; 108/55.1, 55.5; 220/1.5

[56] References Cited

U.S. PATENT DOCUMENTS

| | | | |
|---|---|---|---|
| 3,912,103 | 10/1975 | Gerhard | 220/1.5 |
| 4,065,022 | 12/1977 | Cainaud | 248/146 X |
| 4,307,812 | 12/1981 | Gerhard | 220/1.5 |

FOREIGN PATENT DOCUMENTS

| | | | |
|---|---|---|---|
| 1938374 | 12/1971 | Fed. Rep. of Germany | 220/1.5 |
| 2531681 | 1/1977 | Fed. Rep. of Germany | 220/1.5 |
| 2816845 | 10/1979 | Fed. Rep. of Germany | 220/1.5 |
| 2900419 | 7/1980 | Fed. Rep. of Germany | 220/1.5 |
| 7104141 | 9/1971 | Netherlands | 248/146 |
| 1362461 | 8/1974 | United Kingdom | 220/1.5 |

*Primary Examiner*—Ramon S. Britts
*Assistant Examiner*—Sarah A. Lechok
*Attorney, Agent, or Firm*—Alan H. Levine

[57] ABSTRACT

A mounting for a tank receptacle in a lattice-shaped, stackable, cage-like supporting framework surrounding the receptacle. The receptacle is supported in the framework at three points in the case of a supporting framework which is not torsionally rigid relative to the receptacle. Where the receptacle is supported at four points in the framework, two support points are defined by hinges connected to each other through equalizing connecting rods. A strap connects the receptacle to the framework at each support point, a lever being located between each hinge and its respective strap. Spring-loaded buffers limit the movement of the levers.

10 Claims, 5 Drawing Figures

MOUNTING FOR A TANK RECEPTACLE IN A SUPPORTING FRAMEWORK

The storage and transport of liquids in tank receptacles is common practice. Tank receptacles are generally cylindrical receptacles of steel, or of a light metal, which are relatively long in relation to their cross section.

For some time, it has also been known how to support such tank receptacles in a supporting framework, in order to improve handling and to rationalize the transport. Receptacle and supporting framework form one structural unit, whose outer contour is determined by the rectangular shape of the supporting framework. In this manner, tank receptacles, as well as conventional, parcelled-goods receptacles can be handled and stacked. With appropriate design, they are even compatible with conventional parcelled-goods receptacles, i.e., they can be stacked in any sequence together with parcelled-goods receptacles, and lifting gear for moving parcelled-goods receptacles is also suitable without modification for tank receptacles.

This invention is concerned with the problem of mounting such tank receptacles in such supporting frameworks. Accordingly, the invention relates to the mounting of a largely torsionally rigid tank receptacle in a lattice-shaped, stackable, cage-like supporting framework, which surrounds the receptacle.

Until now, the mounting of tank receptacles in supporting frameworks was accomplished by arranging in the area of each end of the receptacle a saddle piece, which is a part of the supporting framework and which accommodates the receptacle on a bearing surface which matches the contour of the receptacle. The receptacle is held in the respective saddle pieces with suitable tensioning elements and secured against movements of the receptacle relative to the supporting framework. Depending on the stresses, the supporting framework is occasionally reinforced in the lower region relative to the upper region. In the case of these arrangements, dimensions of the supporting framework and the receptacle must be carefully matched, so as to avoid an uneven distribution of the weight of the receptacle over the saddle pieces, which would subject the receptacle to bending and torsional forces even while it is at rest. During transport, the danger exists that distortions of the supporting framework may reach the receptacle and distort it. Admittedly, the known supporting framework makes the tank receptacle more handleable and stackable. However, the supporting framework does not keep the tank receptacle sufficiently free of undesirable stresses.

The object of the present invention is to provide a remedy, and to connect the tank receptacle with the supporting framework in such a manner that possible distortions of the supporting framework are not transmitted to the tank receptacle.

In order to accomplish this objective, the present invention suggests that, in the case of a supporting framework which, relative to the tank receptacle, is not rigid torsionally, the receptacle be supported in the supporting framework at three points. By doing so, the receptacle is supported statically firmly in the supporting framework. Consequently, distortions of the framework, which can result, for example, during ship transport through forcible distortions within a stack of receptacles, are reliably kept from the tank receptacle.

The receptacle itself and its connecting elements with its supporting framework are therefore stressed significantly less than in the case of the known arrangement, less is demanded of the connections than previously, and, in spite of a weaker method of construction, the connections will have a considerable longer service life than previously.

In an appropriate manner, the statically fixed support may be effected in accordance with the invention by providing four points of support, two of which are constructed as hinges and connected with each other through equalizing rods. If the receptacle and the supporting framework have a shape which is relatively long with a relatively small cross section, the two points of support of a narrow side are connected with each other in the manner described.

The points of support are appropriately designed with straps, with which the receptacle is supported in the supporting framework. This arrangement offers the advantage that differently dimensioned tank receptacles, especially receptacles with different cross sections, can be supported in supporting frameworks of the same dimensions. The different dimensions of different receptacles can be taken into consideration by straps of different dimensions, provided that the supporting surfaces of the supporting framework have the same distances from one another. This is regarded as a very important feature of the invention which, in conjunction with the statically fixed support, can be accomplished particularly well.

The movement of levers, provided by the invention in conjunction with the straps, is limited by spring-loaded buffers in order to stabilize the mounting which inherently is flexible.

The previously described support of the receptacle in the supporting framework is accomplished preferably in the region below the horizontal transverse median plane of the receptacle. In order to stabilize the upper longitudinal members of the supporting framework, elastic thrust bearings are arranged above the horizontal transverse median plane. The frame is provided with elastic give by these bearings. Preferably, support pairs of reinforcements are arranged above and below the horizontal transverse median plane, in the same vertical transverse plane in the region between the vertical transverse median plane and the end of the receptacle. In this connection, supporting rings, which are known, should encircle and reinforce the receptacle in these vertical transverse planes as well as make it possible to take hold of the support or to suspend the receptacle.

The invention is also concerned with providing a supporting framework adapted, in a particularly advantageous manner, to the mounting of the receptacle in the supporting framework. This special structure of the supporting framework results in sufficient stability of the framework, without however requiring more material than necessary for this purpose. As a consequence of the statically fixed support of the receptacle, it is not necessary to be particularly extravagant to achieve greater stiffness of the supporting framework, as unavoidable distortions of the supporting framework do not affect the receptacle.

A preferred embodiment illustrating of the operation of the invention is explained in greater detail in the following description with reference to the accompanying drawings. In the drawings.

Figure 1:
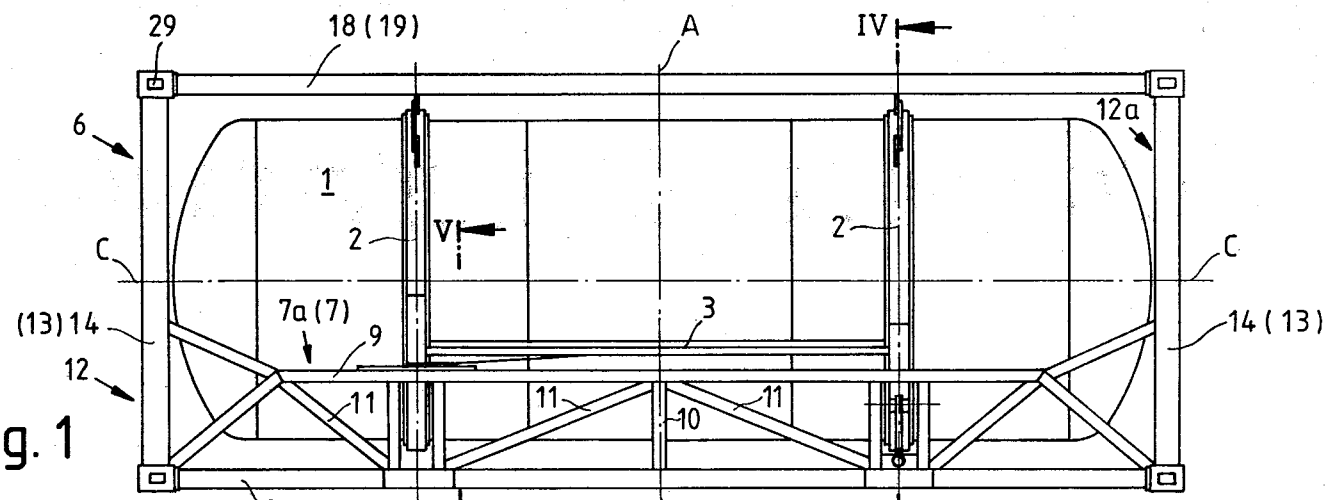
FIG. 1 shows a unit, consisting of a receptacle and a supporting framework, in side elevation.
Figure 2:
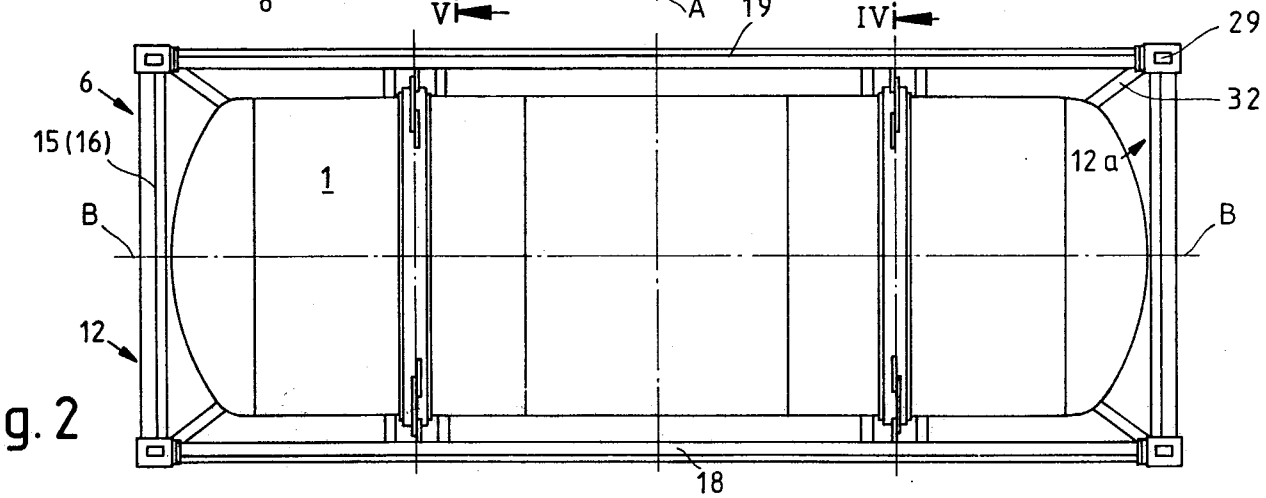
FIG. 2 shows the same unit in plan view.

A conventional tank receptacle 1 consists of a cylindrical center piece which is capped at both ends. In relation to its length, the cross section of the receptacle is relatively small. In each of the regions between the vertical transverse median plane A of the receptacle and its ends, a reinforcing ring 2 is located around the receptacle. The cross section of the reinforcing rings may be selected as desired. Preferably, however, each ring has the contour of a U, closed toward the outside. On each longitudinal side of the receptacle, the reinforcing rings 2 are mutually reinforced by a longitudinal strut 3.

At each reinforcing ring 2, a triangular reinforcing bracket 4 is attached on each side of the longitudinal median plane B and below the horizontal median plane C. The length of the brackets depends on the ratio between the diameter of the receptacle and the width of the supporting framework. As a consequence of this type of support, receptacles of very different diameters can be supported in supporting frameworks of the same width.

At the side of the vertical longitudinal median plane B, and above the horizontal median plane C, there are attached at each reinforcing ring thrust bearing parts 5, which are a part of each elastic suspension of the receptacle in the supporting framework.

The supporting framework 6 consists essentially of two lower, lateral longitudinal members 7, 7*a*, each of which is formed from a latticework. The latticework of each longitudinal member consists of a lower chord 8, which forms the bottom edge of the supporting framework 6, an upper chord 9 at a height approximately level with one quarter of the total height of the supporting framework, and diagonal and vertical struts 10 and 11. The two longitudinal members 7, 7*a* extend between the end frames 12, 12*a* of the supporting framework 6 and are connected thereto at a height which is greater than the height of the members. Each end frame 12 or 12*a* consists of two vertical corner pillars 13, 14, which are connected with each other at the upper and lower ends by cross members 15 and 16. The end frames, formed by the corner pillars and the cross members, fix the cross section of the supporting framework 6. Four diagonal struts 17 act as reinforcement for each of the squares formed by the corner pillars 13, 14 and the cross members 15, 16. The upper corners of the two end frames are connected to each other by upper longitudinal members 18, 19.

Figure 5:
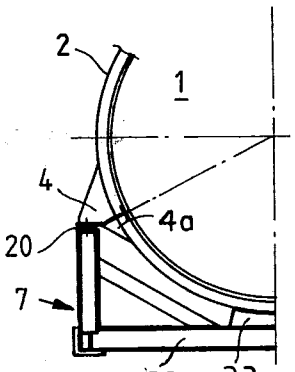
FIG. 5 shows a cross-sectional view taken along the line V—V of FIG. 1.

The receptacle is supported directly on the two lower longitudinal members 7, 7*a* by means of triangular brackets 4 at one end of the receptacle (FIG. 5), so that two fixed supports are formed in these areas. To ease the burden of forces of acceleration, acting horizontally in the direction of the longitudinal axis of the receptacle on the attachments to the fixed supports, blocks 4*a* are welded on both cross sides of the respective longitudinal member 7 or 7*a* alongside the bracket 4 (fixed support). In other respects, longitudinal members and brackets are held together with nuts and bolts.

Figure 4:
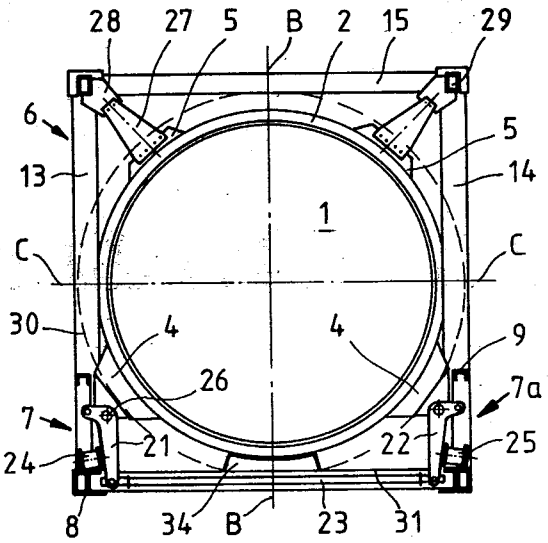
FIG. 4 shows a cross-sectional view taken along the line IV—IV of FIG. 1.
Figure 3:
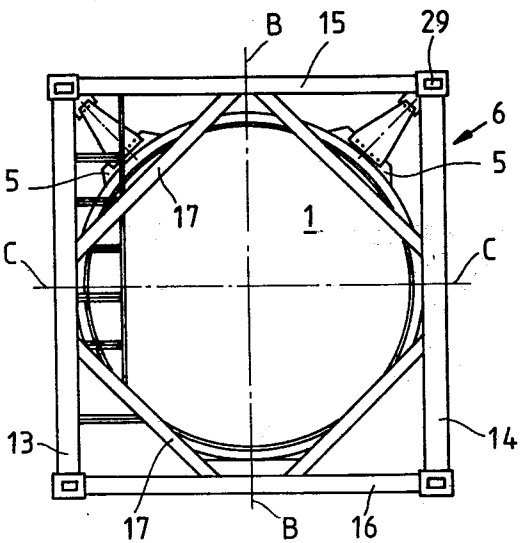
FIG. 3 shows the same unit in a front view.

The receptacle is supported at the apex of each lever 21 or 22 by brackets 4 near the other end of the receptacle (FIG. 4). Each lever is pivoted with the shorter leg at one of the two longitudinal members 7, 7*a*. The other, longer legs of the two levers 21, 22 are connected with each other through a connecting rod 23 or an equalization rod and hinges. The pivotal movements of the levers 21, 22 are limited by spring-loaded buffers 24, 25. In this manner, the two support points shown in FIG. 4 form one compensating support and, functionally, the receptacle is supported in the supporting framework at three points.

In order to permit different longitudinal expansions of the receptacle and the supporting framework, the apexes of the levers 21, 22 are supported on axle pivot pins 26 of the brackets 4, at one end of the receptacle, in such a manner that limited longitudinal movements are possible between the brackets and the levers.

The thrust bearing parts 5, in the upper region of the reinforcing rings 2, are engaged by deflectable, elastic supports 27, whose other ends are held by retaining brackets 28 on the upper longitudinal members 18, 19. The elastic thrust bearings, formed in this manner, serve to stabilize the receptacle relative to the upper longitudinal members of the supporting framework, without impairing the three-point mounting and the longitudinal motion between the receptacle and the supporting framework.

The upper and lower ends of the corner pillars 13 and 14 are provided with metal fittings 29, with which corresponding other units can be brought together so that several corresponding units can be stacked on top of one another and locked together. The metal fittings are designed to be installed and disassembled in order to facilitate the installation and dismantling of receptacles.

The circumference of the largest possible receptacle, which can be mounted in the supporting framework 6 shown, is indicated by the dashed line 30.

In the case of greater loads on cross beams 31, 32 in the supporting planes due to external influences, such as, supporting forces on the chassis frames of truck or railroad vehicles, the cross beams 31, 32 can be supported by means of locating blocks 33, 34 at the encircling support rings 2.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A supporting arrangement for a substantially torsionally rigid tank receptacle, the supporting arrangement comprising:

a latticed cage-like framework adapted to accommodate a tank, the framework being torsionally flexible and stackable with similar frameworks, and a plurality of support means for mounting a tank within the framework, one of the support means being spaced from the others in the longitudinal direction of the tank, said one support means including two support members for pivotally joining the tank to the framework, and means for interconnecting the two support members, whereby torsional flexing of the framework is not transmitted to the tank.

2. A supporting arrangement according to claim 1 wherein the support means spaced from said one support means include two support members fixed with respect to both the tank receptacle and the framework.

3. A supporting arrangement according to claim 1 wherein each of said support members includes a link hinged to both the tank receptacle and the framework.

4. A supporting arrangement according to claim 3 wherein each link includes a first arm pivoted to both the tank receptacle and the framework, and a second arm pivoted to a rigid connecting rod which extends between the second arm of the two links.

5. A supporting arrangement according to claim 3 including spring-loaded buffers for limiting the swinging movements of the two links.

6. A supporting arrangement according to claim 1 wherein said support means are located below a horizontal median plane passing through the tank receptacle.

7. A supporting arrangement according to claim 6 including means located above said horizontal median plane for resiliently interconnecting the tank receptacle and the framework.

8. A supporting arrangement according to claim 1 including reinforcing rings extending around the tank receptacle coaxial to the longitudinal axis of the receptacle, said support means being connected to the reinforcing rings.

9. A supporting arrangement according to claim 8 wherein the framework includes a cross beam and a locating block in the vertical plane which contains each reinforcing ring, the beam and bock helping to support the receptacle.

10. A supporting arrangement according to claim 1 wherein the two support members also permit limited relative movement, between the receptacle and the framework, in the longitudinal direction of the framework, so as to compensate for differential expansion and contraction between the receptacle and the framework.

* * * * *